US010108119B1

(12) United States Patent
Yahata

(10) Patent No.: US 10,108,119 B1
(45) Date of Patent: Oct. 23, 2018

(54) IMAGE FORMING APPARATUS WHICH CAN FORM AN IMAGE ON A LABEL SHEET AND CONTROL METHOD THEREOF

(71) Applicants: KABUSHIKI KAISHA TOSHIBA, Tokyo (JP); TOSHIBA TEC KABUSHIKI KAISHA, Tokyo (JP)

(72) Inventor: Isao Yahata, Izunokuni Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/877,564

(22) Filed: Jan. 23, 2018

(30) Foreign Application Priority Data

Jul. 20, 2017 (JP) ..... 2017-141236

(51) Int. Cl.
*G03G 15/20* (2006.01)
*G09F 3/00* (2006.01)
*G09F 3/02* (2006.01)

(52) U.S. Cl.
CPC ..... *G03G 15/2078* (2013.01); *G03G 15/2053* (2013.01); *G09F 3/00* (2013.01); *G09F 2003/0201* (2013.01); *G09F 2003/023* (2013.01)

(58) Field of Classification Search
CPC ..... G03G 15/2039; G03G 15/2042; G03G 15/2053; G03G 15/2078; G03G 15/2082
USPC ..... 399/45, 69, 334
See application file for complete search history.

(56) References Cited

U.S. PATENT DOCUMENTS 6,882,804 B2 * 4/2005 Eskey ..... G03G 15/2042 399/45
7,034,855 B2 4/2006 Muto et al.
7,228,082 B1 * 6/2007 Davidson et al. ..... G03G 15/2064 399/45
7,738,805 B2 * 6/2010 Lofthus et al. .... G03G 15/2007 399/69

* cited by examiner

*Primary Examiner* — William J Royer
(74) *Attorney, Agent, or Firm* — Patterson & Sheridan, LLP

(57) ABSTRACT

An image forming apparatus includes a sheet transport path, a toner image transfer section along the sheet transport path at which a toner image is transferred to a sheet conveyed along the sheet transport path, a heating unit downstream from the toner image transfer section in a sheet transporting direction, the heating unit having a plurality of heating members arranged along a sheet width direction, and a control unit. The control unit is configured to determine locations of end portions of a label on the sheet in the sheet width direction, and during heating of the sheet by the heating unit, control heating members at locations facing the end portions of the label to generate less heat than the one or more of the other heating members.

20 Claims, 11 Drawing Sheets

IMAGE FORMING APPARATUS WHICH CAN FORM AN IMAGE ON A LABEL SHEET AND CONTROL METHOD THEREOF

CROSS-REFERENCE TO RELATED APPLICATION

This application is based upon and claims the benefit of priority from Japanese Patent Application No. 2017-141236, filed Jul. 20, 2017, the entire contents of which are incorporated herein by reference.

FIELD

Embodiments described herein relate generally to an image forming apparatus and a control method thereof.

BACKGROUND

There is an image forming apparatus which can form an image on a label sheet. The label sheet is a sheet on which a label is affixed. The label and the sheet are adhered to each other by an adhesive. Therefore, the adhesive may leak out from an outer edge of the label when the label sheet is heated and pressurized during fixing of a toner image. When the adhesive leaks out from the outer edge of the label due to the fixation, the adhesive may come into contact with a fixing device and a sheet transporting guide, or the like continuously while transporting the label sheet. As a result of this contact, there is a problem that dirt adheres to the fixing device and the sheet transporting guide and the dirt interferes with the printing process and the sheet transport.

DETAILED DESCRIPTION

Embodiments provide an image forming apparatus and a control method which can suppress dirt that sticks to an adhesive from a label sheet that remains on components of the image forming apparatus when printing is performed on the label sheet.

An image forming apparatus of the embodiment includes a sheet transport path, a toner image transfer section along the sheet transport path at which a toner image is transferred to a sheet conveyed along the sheet transport path, a heating unit downstream from the toner image transfer section in a sheet transporting direction, the heating unit having a plurality of heating members arranged along a sheet width direction, and a control unit. The control unit is configured to determine locations of end portions of a label on the sheet in the sheet width direction, and during heating of the sheet by the heating unit, control heating members at locations facing the end portions of the label to generate less heat than the one or more of the other heating members.

In an image forming apparatus of an embodiment, it is possible to provide the image forming apparatus which can prevent an adhesive from leaking out from an outer edge of a label sheet. Hereinafter, the image forming apparatus of the embodiment will be described in detail.

Figure 1:
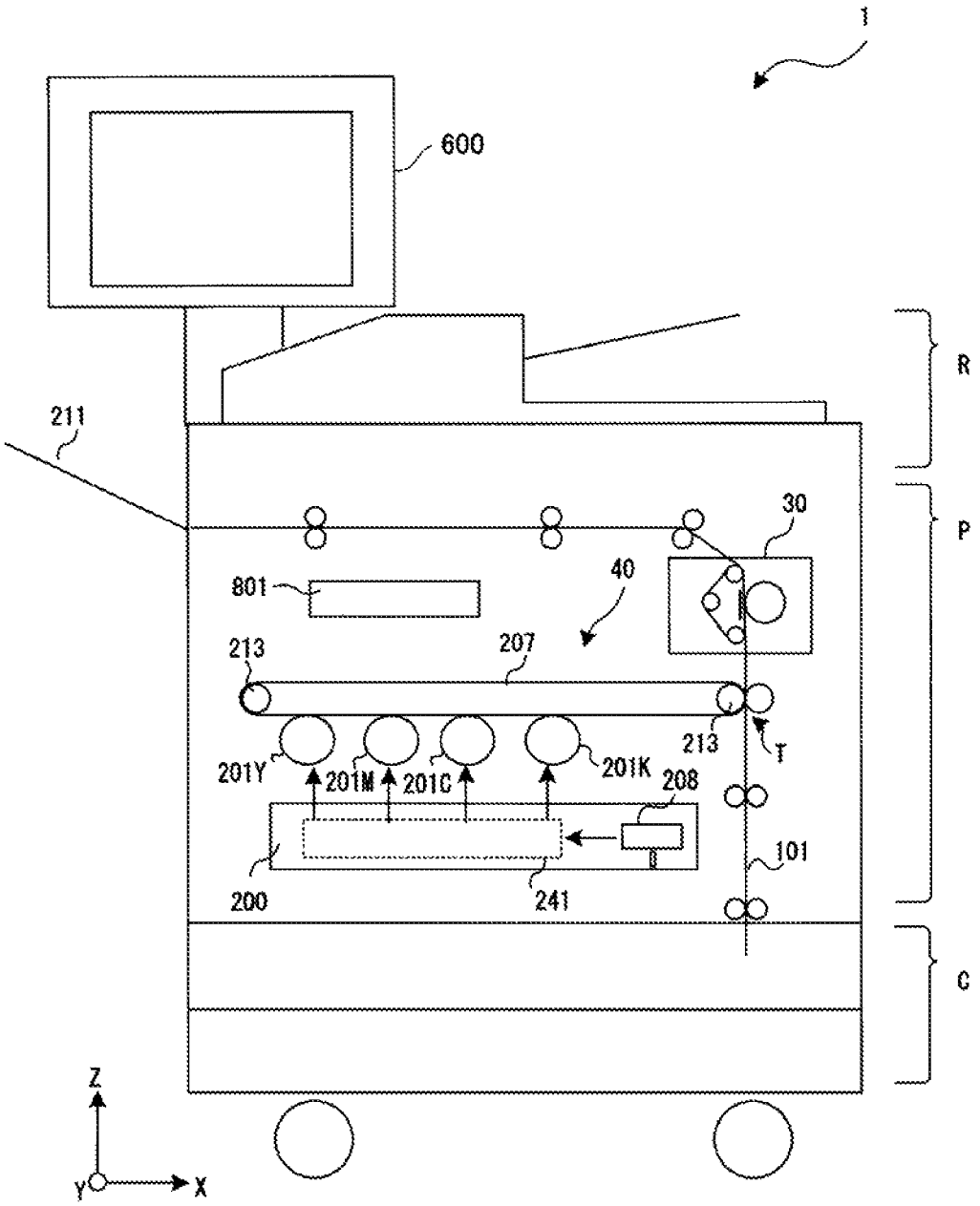
FIG. 1 is a schematic diagram of an image forming apparatus of an embodiment.

FIG. 1 is a schematic diagram of an image forming apparatus 1 of the embodiment. The image forming apparatus 1 includes a reading unit R, an image forming unit P, a sheet feed cassette unit C, and a control panel 600. The reading unit R reads a document sheet placed on a document table by a charge-coupled device (CCD) image sensor or the like, and converts an optical signal into digital data. The image forming unit P obtains print data from a document image read by the reading unit R or an external personal computer, and forms and fixes a toner image on the sheet.

The image forming unit P includes a laser scanning unit 200 and photosensitive drums 201Y, 201M, 201C, and 201K. The laser scanning unit 200 includes a polygon mirror 208 and an optical system 241, and irradiates the photosensitive drums 201Y to 201K with light of an image formed on the sheet based on an image signal of each color of yellow (Y), magenta (M), cyan (C), and black (K).

The photosensitive drums 201Y to 201K hold toners of respective colors supplied from a developing device (not shown) according to positions of the irradiation. The photosensitive drums 201Y to 201K sequentially transfer the toner images formed thereon to an outer peripheral surface of a transfer belt 207. The transfer belt 207 is an endless belt, and transfers the toner image to a transfer position T by rotationally driving a roller 213.

Along a transport path 101, sheets stacked on the sheet feed cassette unit C are transported in order of the transfer position T, a fixing device 30, and a discharge tray 211. The sheet stacked on the sheet feed cassette unit C is transported to the transfer position T along the transport path 101, and the toner image is transferred onto the sheet at the transfer position T from the transfer belt 207.

The sheet on which the toner image is transferred from the transfer belt 207 is transported to the fixing device 30 along the transport path 101. The fixing device 30 heats and melts the toner image so as to fix the image onto the sheet. With this process, the toner image on the sheet is prevented from being disturbed by an external force. The sheet on which the toner image is fixed, is transported to the discharge tray 211 along the transport path 101 after passing through the fixing device 30.

A control unit 801 is a unit that controls a device and a mechanism in the image forming apparatus 1. A transfer unit 40 transfers a toner image carried by the transfer belt 207 onto the sheet.

The control panel 600 displays various types of information to a user, and receives an operation of the user. In this embodiment, one type label sheet is selected from a plurality of different types of the label sheets, each having a different position for the label. The type of the label sheet can be selected by an operation input through the control panel 600, and the selected type of the label sheet is informed to the control unit 801. The control unit 801 designates a resistance heating member corresponding to an end portion of the label sheet as an end portion resistance heating member. Detail of the resistance heating members will be described later. The control unit 801 controls the temperature of the specified end portion resistance heating member to be a temperature lower than that of another resistance heating member.

Figure 2:
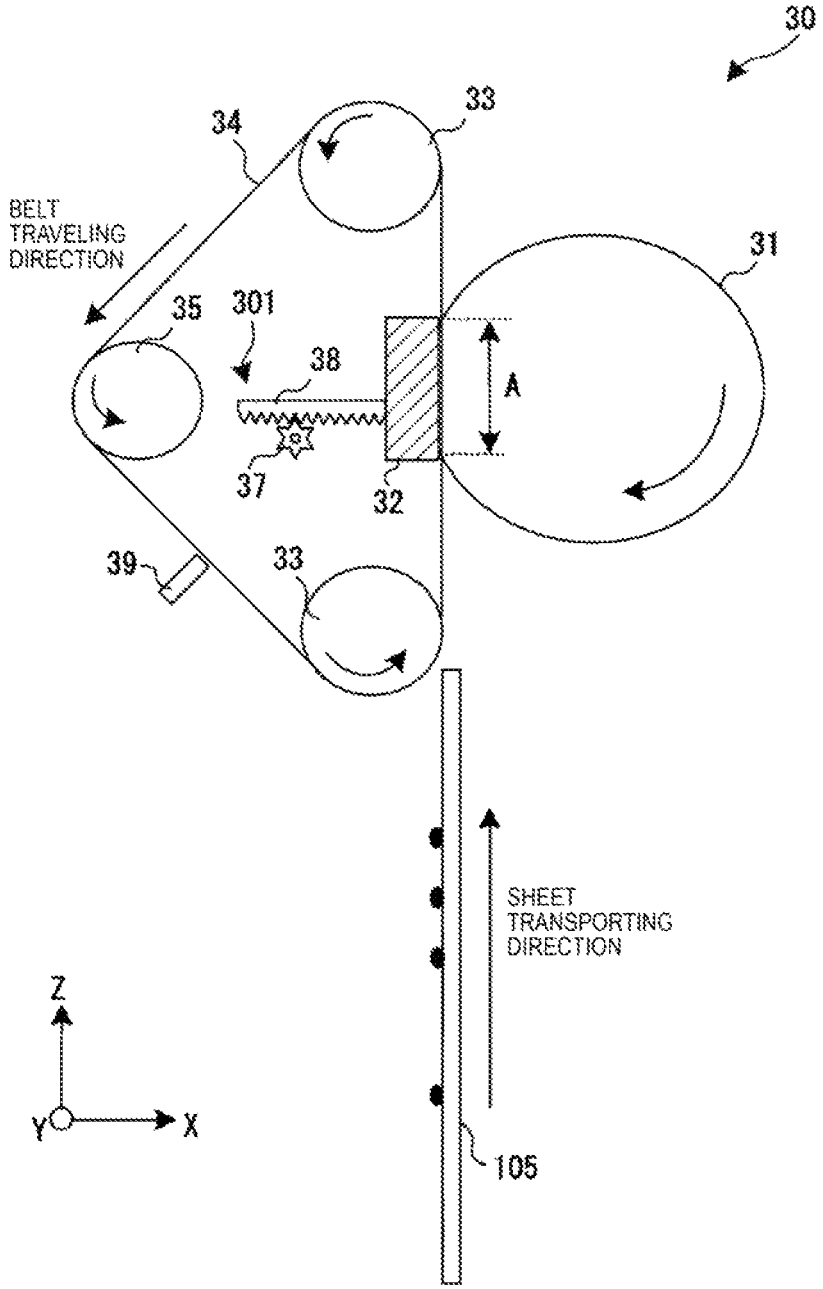
FIG. 2 is a diagram illustrating a configuration example of a fixing device.

FIG. 2 is a diagram illustrating a configuration example of the fixing device 30. The fixing device 30 performs a fixing process in which the image transferred on the sheet is fixed on the sheet. The fixing device 30 includes a plate shape heating member 32 and an endless belt 34 suspended on a plurality of rollers. The endless belt 34 is a member including an elastic layer (for example, Si rubber). In addition, the fixing device 30 includes rollers 33 and 35 for rotating in a fixed direction, and the endless belt 34 is suspended over the rollers 33 and 35. In addition, the fixing device 30 includes a pressure roller 31 on which the elastic layer is formed. The pressure roller 31 transports the sheet while clamping the sheet together with the endless belt 34 during the fixing process. The pressure roller 31 is driven by a driving source to rotate in an opposite direction with respect to the endless belt 34.

The heating member 32 is in contact with an inner surface of the endless belt 34, and presses the endless belt 34 toward the direction of a pressure roller 31. With this arrangement, the heating member 32 nips, heats, and presses a sheet 105 carrying the toner image and transported to a contact portion (nip portion) formed between the heating member 32 and the pressure roller 31. The heating member 32 is in contact with an inner side surface of the endless belt 34, and heats the endless belt 34 in a state where the endless belt 34 is pressed on a pressure roller 31 side. The heating member 32 includes a resistance heating member 60 including a plurality of resistance heating members 61 in the inside thereof. Before the fixing process, a temperature increasing process in which the temperature of the heating member 32 increases by the resistance heating member 60 is performed. As described above, the fixing device 30 transports the sheet while heating and clamping the sheet by the resistance heating member 61. In addition, the resistance heating member 60 is provided downstream from the transfer unit 40 in the sheet transporting direction.

The fixing device 30 includes a nip adjusting mechanism 301 including a gear 37 and a rack 38. One end portion of the rack 38 is in contact with the heating member 32, and meshed with the gear 37. By rotating the gear 37, the rack 38 moves in the horizontal direction (X-axis direction). As described above, with the nip adjusting mechanism 301, rotational movement is converted into linear movement. The rack 38 moves in the horizontal direction such that the heating member 32 also moves in the horizontal direction in conjunction with this movement. When an axis of the pressure roller 31 is at a fixed position, the heating member 32 approaches or is separated from the pressure roller 31 in accordance with the rotation direction of the gear 37. The nip adjusting mechanism. 301 may be moved in a direction in which at least one of the pressure roller 31 and the heating member 32 is separated from the other or approaches the other. Accordingly, for example, the nip adjusting mechanism 301 moves a holding member holding the axis of the pressure roller 31 such that the pressure roller 31 may be moved in the direction away from the heating member 32 or toward the heating member 32. As described above, with the nip adjusting mechanism 301, a nip width between the heating member 32 and the pressure roller 31 can be adjusted. In other words, the nip adjusting mechanism. 301 adjusts a length A (nip width A) in a sheet transporting direction of a clamping region for clamping the endless belt 34 in the heating member 32 and the pressure roller 31.

In addition, the fixing device 30 includes a temperature sensor 39 as shown. The temperature sensor 39 detects a surface temperature of the endless belt 34, and outputs the detected temperature to the control unit 801.

Figure 3:
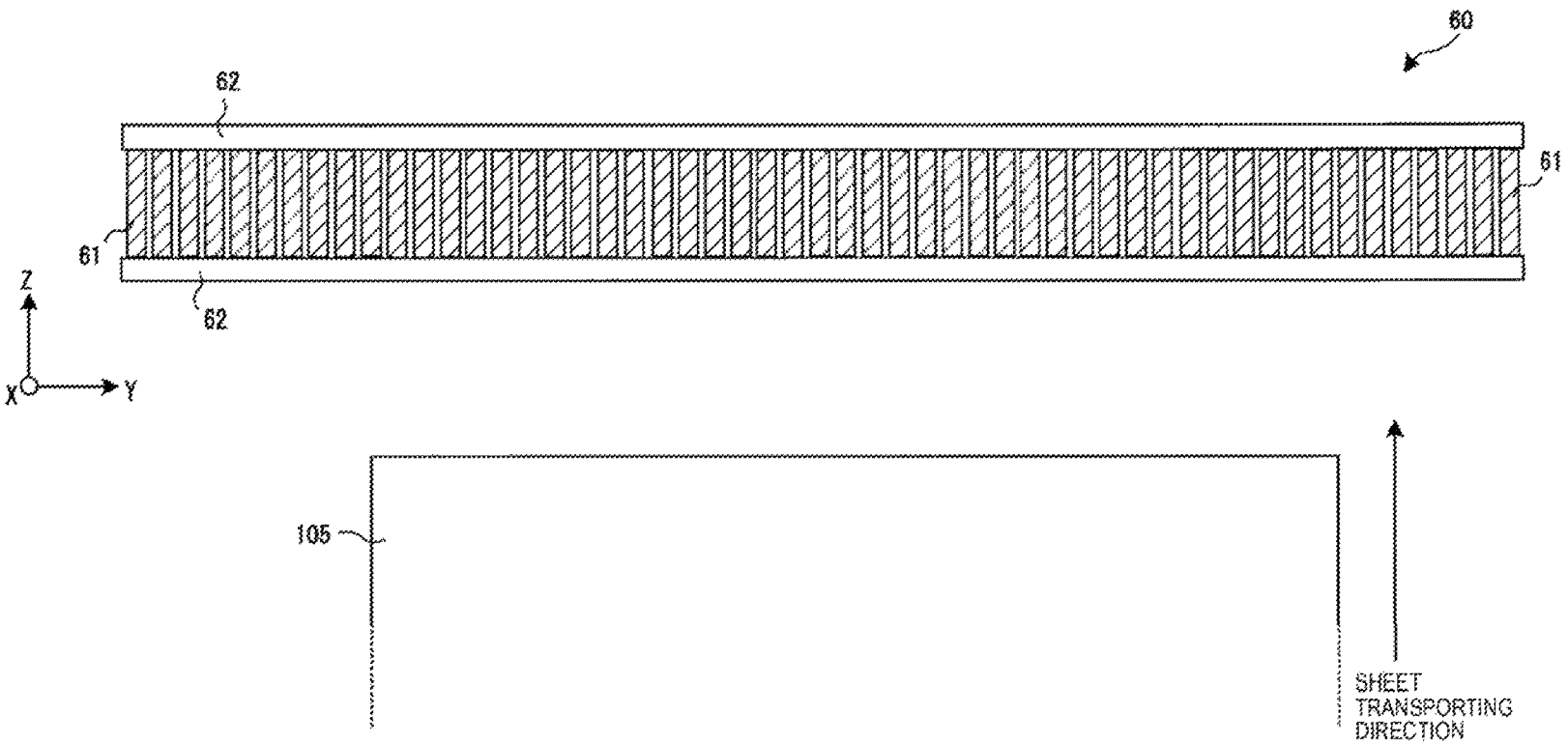
FIG. 3 is a diagram illustrating a resistance heating member.

FIG. 3 is a diagram illustrating the resistance heating member 60 included within the heating member 32. The resistance heating member 60 is a plate that faces a surface of the sheet 105 to be transported, and configured with a plurality of the resistance heating members 61. The resistance heating members 61 are disposed within respective cell regions such that the resistance heating member 60 is divided into a plurality of members in the Y direction that is perpendicular to the sheet transporting direction. Each of both ends of the resistance heating members 61 is connected to an electrode 62, and the resistance heating members 61 generate heat when they are energized through the electrode 62. The electrode 62 is formed by an aluminum layer, for example. As described above, a plurality of the resistance heating members 61 heating the sheet 105 are provided in a direction perpendicular to a transporting direction.

In this embodiment, the resistance heating members 61 are divided into groups, the resistance heating members 61 are heated on a per group basis. A plurality of groups (e.g., GROUP A-G shown in FIG. 6, which will be explained later) are used.

Figure 4:
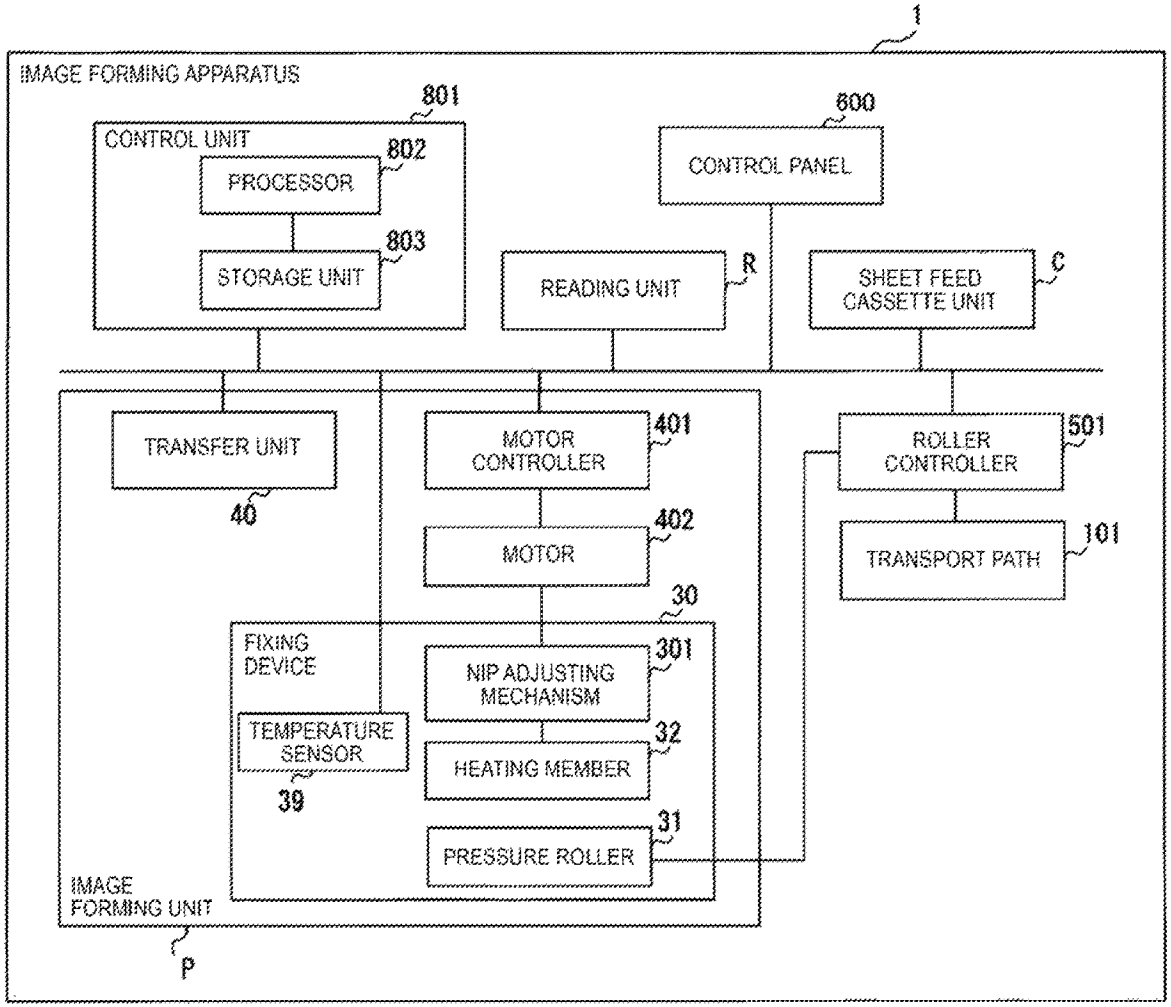
FIG. 4 is a block diagram of the image forming apparatus.

FIG. 4 is a block diagram of the image forming apparatus 1. The image forming apparatus 1 has the hardware configuration shown above in FIG. 1 to FIG. 3. Hardware components that have not been described yet will now be described. The control unit 801 includes a processor 802 and a storage unit 803. The processor 802 is a central processing unit (CPU), and the storage unit 803 is a volatile or non-volatile storage unit for storing data and a program. In one embodiment, the processor 802 executes a program stored in the storage unit 803 such that the control unit 801 controls devices and mechanisms in the image forming apparatus 1. In addition, part of the control functions may be implemented as a circuit. As described below, the control unit 801 performs control for adjusting the nip width A during the temperature increasing process and during the fixing process, and also serves an operation as an element of the fixing device 30.

A motor 402 is a stepping motor connected to a shaft of the gear 37 of the nip adjusting mechanism 301, and rotates the gear 37. With this configuration, the nip adjusting mechanism 301 moves the heating member 32 in the horizontal direction.

A motor controller 401 controls driving of the motor 402 in accordance with an instruction from the control unit 801. A roller controller 501 controls driving, stopping, and rotation speed of a pair of rollers and the pressure roller 31 in the transport path 101 in accordance with an instruction from the control unit 801.

Since units other than units illustrated in FIG. 4 are already explained by using FIG. 1 to FIG. 4, description thereof will be omitted here.

Figure 5:
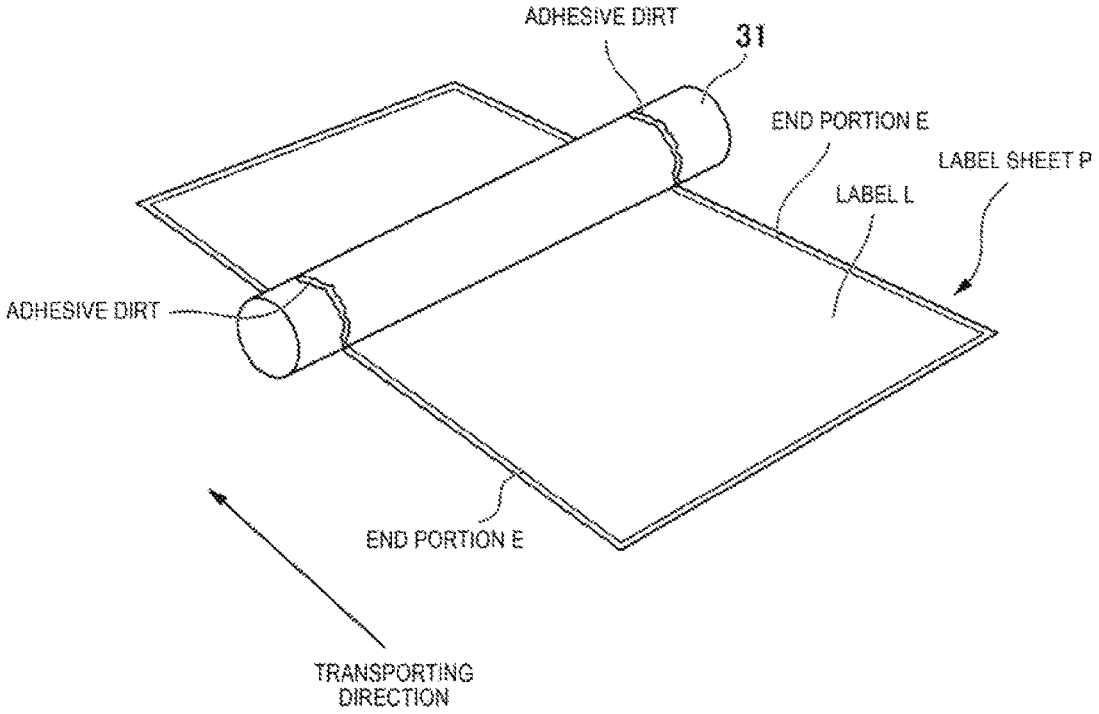
FIG. 5 is a diagram illustrating an example of an adhesive sticking to a pressure roller.

Next, dirt generated in a case where the sheet 105 is processed as a label sheet P will be described. FIG. 5 is a diagram illustrating an example of the adhesive of the pressure roller 31. The pressure roller 31 and a label sheet P are illustrated in FIG. 5. The label L is provided on the label sheet P. Then, two end portions E in parallel with the transporting direction of the label sheet P are illustrated in FIG. 5.

If the entire resistance heating member 60 generates heat, the adhesive in the vicinity of the end portion E of the heated label L tends to melt. When the adhesive is melted, the melted adhesive leaks from the end portion E of the label L such that the adhesive begins sticking to the pressure roller 31. Therefore, every time the image forming apparatus 1 performs printing on the label sheet P, the adhesive gradually builds up around the pressure roller 31 as dirt.

Accordingly, in this embodiment, the control unit 801 designates the resistance heating member 61 corresponding to end portions of the label provided in the label sheet P as the end portion heating member. The control unit 801 controls the temperature of the designated end portion heating member to be a temperature lower than that of other resistance heating members 61. In this embodiment, the control unit 801 controls the end portion heating member so that it does not generate heat.

Figure 6:
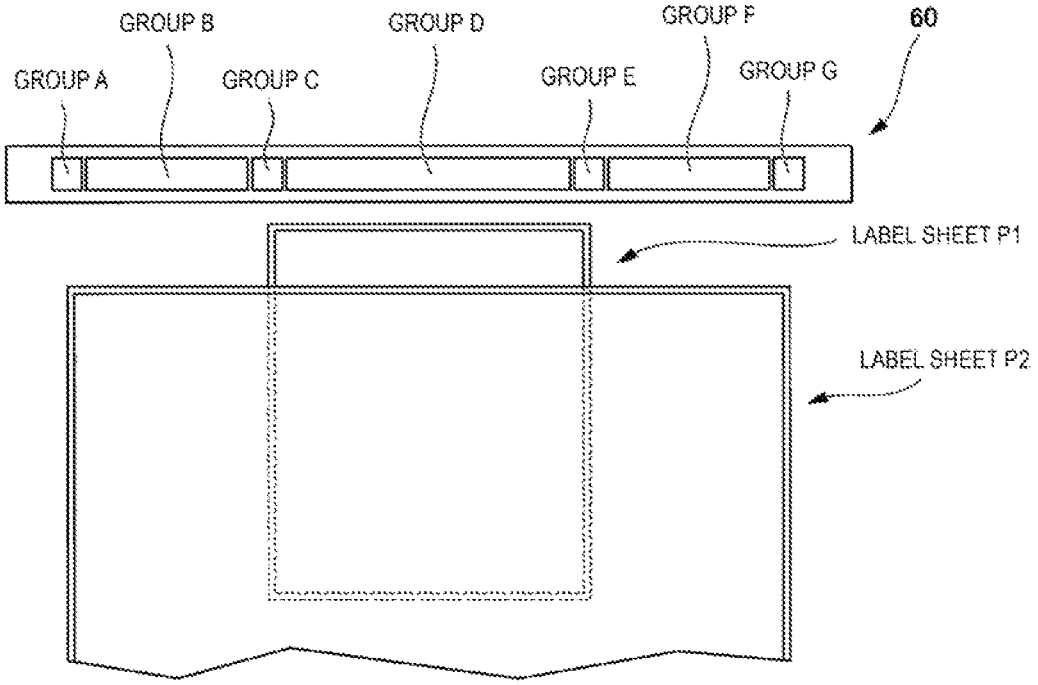
FIG. 6 is a diagram illustrating an example of correspondence between grouped resistance heating member and a label sheet.

FIG. 6 is a diagram illustrating an example of correspondence between the grouped resistance heating members 61 and the label sheet. The resistance heating member 60 and the label sheets P1 and P2 of different types are illustrated in FIG. 6. The resistance heating members 61 included in the resistance heating member 60 are grouped into seven groups A to G. Information for designating the end portion heating member is stored in the storage unit 803 for each of the label sheets P1 and P2.

First, in a case of a label sheet P1, the heating member corresponding to an end portion includes resistance heating members 61 belonging to groups C and E. Therefore, in a case of a label sheet P1, the resistance heating members 61 belonging to the groups C and E are the end portion heating member. The groups C and E are stored in the storage unit 803 in association with the label sheet P1.

In a case where the label sheet P1 is selected by the control panel 600, the control unit 801 obtains the groups C and E. With this process, the control unit 801 designates the heating member corresponding to the end portion of the label sheet P1 as the end portion heating member. Then, the control unit 801 controls the designated end portion heating member not to generate heat. It is also not necessary to energize the resistance heating members 61 belonging to the groups A, B, F, and G. Accordingly, the control unit 801 controls the resistance heating members 61 belonging to the groups A, B, C, E, F, and G not to be energized. Meanwhile, the control unit 801 controls the resistance heating members 61 belonging to the group D to generate heat.

Next, in a case of the label sheet P2, the heating member corresponding to an end portion of the label sheet P2 includes the resistance heating member 61 belonging to the groups A and G. Accordingly, in a case of the label sheet P2, the resistance heating members 61 belonging to the groups A and G are the end portion heating member. The groups A and G are stored in the storage unit 803 in association with the label sheet P2.

In a case where the label sheet P2 is selected by the control panel 600, the control unit 801 obtains the groups A and G. With this process, the control unit 801 designates the heating member corresponding to the end portion of the label sheet P2 as the end portion heating member. Then, the control unit 801 controls the designated end portion heating member not to generate heat. Meanwhile, the control unit 801 controls the resistance heating members 61 belonging to the groups B, C, D, E, and F to generate heat.

As described in FIG. 6, the control unit 801 controls the resistance heating member 61 corresponding to the end portion of the label sheet not to be heated. With this arrangement, as compared to a case where all the resistance heating members 61 generate heat, it is possible to suppress dirt that is formed due to the adhesive that leaks from the label sheet. Furthermore, as compared to the case where all the resistance heating members 61 generate heat, it is possible to reduce power consumption.

Figure 7:
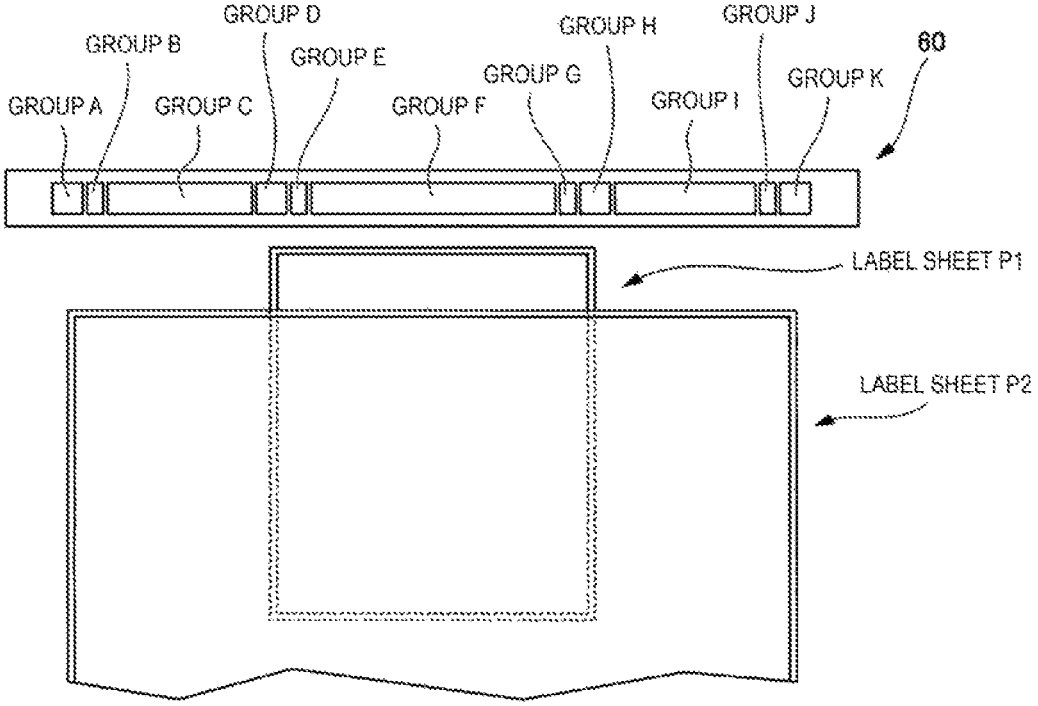
FIG. 7 is a diagram illustrating an example of the correspondence between the grouped resistance heating member and the label sheet.

The group illustrated in FIG. 6 may be subdivided. FIG. 7 is a diagram illustrating an example correspondence between the grouped resistance heating member 61 and the label sheet. Similar to FIG. 6, the label sheets P1 and P2 are of different types. In FIG. 7, the group is further subdivided, and the resistance heating members 61 included in the resistance heating member 60 are grouped into 11 groups of the groups A to K.

First, in a case of the label sheet P1, the heating member corresponding to the end portion of the label sheet P1 includes the resistance heating member 61 belonging to the groups D and H. Accordingly, the resistance heating members 61 belonging to the groups D and H are the end portion heating member. The groups D and H are stored in the storage unit 803 in association with the label sheet P1.

When the label sheet P1 is selected by the control panel 600, the control unit 801 obtains the groups D and H. With this process, the control unit 801 designates the heating member corresponding to the end portion of the label sheet P1 as the end portion heating member. Then, the control unit 801 controls the designated end portion heating member not to generate heat.

It is also not necessary for the resistance heating member 61 belonging to the groups A, B, C, I, J, and K to generate heat. Therefore, the control unit 801 controls the resistance heating members 61 belonging to the groups A, B, C, D, H, I, J, and K not to generate heat. Meanwhile, the control unit 801 controls the resistance heating members 61 belonging to the groups E, F, and G to generate heat.

If the toner image can be fixed on the label sheet P1 by heating with only the resistance heating member 61 belonging to the group F, the resistance heating members 61 belonging to the groups E and G may also be controlled not to generate heat. As described above, by subdividing the groups, it is possible to more flexibly control the heating, according to e.g., thermal conductivity of the heating member 32, a calorific value of the resistance heating member 61, and the like.

Next, in a case of the label sheet P2, the heating member corresponding to the end portion of the label sheet P2 includes the resistance heating members 61 belonging to the groups A and K. Accordingly, the resistance heating members 61 belonging to the groups A and K are the end portion heating member. The groups A and K are stored in the storage unit 803 in association with the label sheet P2.

In a case where the label sheet P2 is selected by the control panel 600, the control unit 801 obtains the groups A and K. With this process, the control unit 801 designates the heating member corresponding to the end portion of the label sheet P2 as the end portion heating member. Then, the control unit 801 controls the designated end portion heating member not to generate heat.

If the toner image can be fixed on the label sheet P2 by heating with only the resistance heating members 61 belonging to the groups C, D, E, F, G, H, and I, the resistance heating members 61 belonging to the groups B and J may also be controlled so as not to generate heat. As described above, by subdividing the group, it is possible to more flexibly control the heating, according to, e.g., the thermal conductivity of the heating member 32, the calorific value of the resistance heating member 61, and the like.

As illustrated in FIG. 7, the control unit 801 controls the temperature of the resistance heating member 61 corresponding to the end portion of the label sheet to be a temperature lower than that of another resistance heating member 61. With this, as compared to the case where all the resistance heating members 61 are heated, it is possible to suppress the dirt that is formed due to the adhesive that leaks from the label sheet. Furthermore, as compared to the case where all the resistance heating members 61 are heated, it is possible to reduce power consumption.

Figure 8:
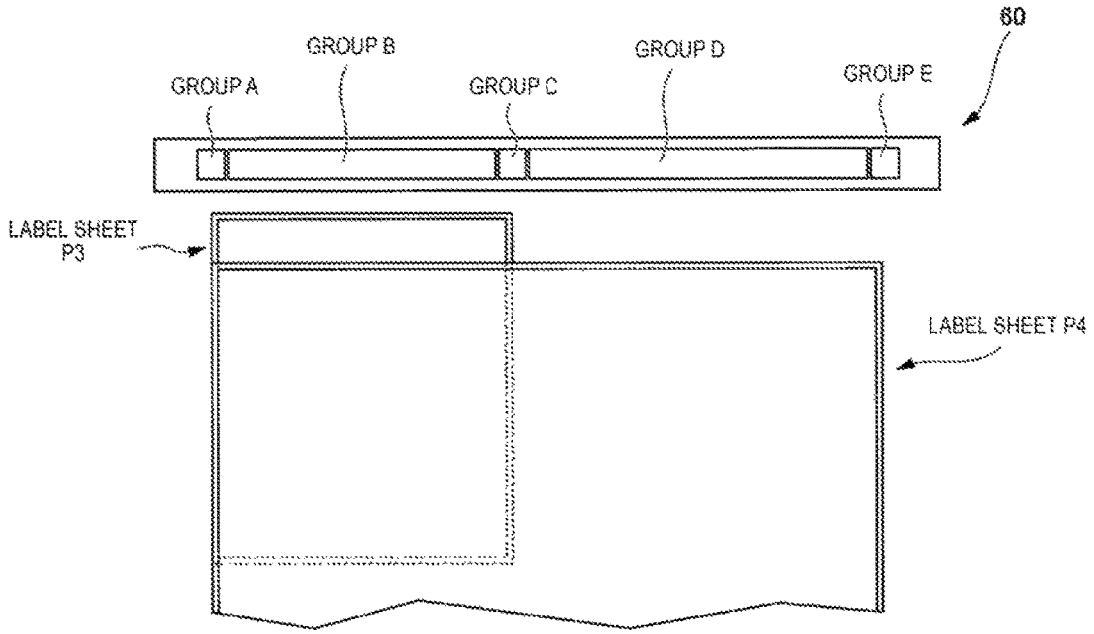
FIG. 8 is a diagram illustrating an example of the correspondence between the grouped resistance heating member and the label sheet in a case where a sheet transport reference is an edge.

In examples illustrated in FIGS. 6 and 7, the sheet passes through a center position of the heating member 32. However, in a case where the sheet transport reference is at an edge, as compared to a case where the sheet transport reference is the center, it is possible to decrease the number of the groups that generate heat. FIG. 8 is a diagram illustrating an example of the correspondence between the grouped resistance heating member 61 and the label sheet in the case where the sheet transport reference is at the edge. In FIG. 8, the edge is at the left end.

The label sheets P3 and P4 of different types are illustrated in FIG. 8. The resistance heating members 61 included in the resistance heating member 60 are grouped into five groups of the groups A to E. Then, the information by which some of the resistance heating members 61 are designated as low temperature heating member, is stored in the storage unit 803 for each of the label sheets P3 and P4.

First, in a case of the label sheet P3, the heating member corresponding to an end portion of the label sheet P3 includes the resistance heating members 61 belonging to the groups A and C. Accordingly, the resistance heating members 61 belonging to the groups A and C become the end portion heating member. The groups A and C are stored in the storage unit 803 in association with the label sheet P3.

When the label sheet P3 is selected by the control panel 600, the control unit 801 obtains the groups A and C. With this process, the control unit 801 designates the heating member corresponding to the end portion of the label sheet P3 as the end portion heating member. Then, the control unit 801 controls the designated end portion heating member not to generate heat. It is also not necessary for the resistance heating members 61 belonging to the groups D and E to generate heat. Therefore, the control unit 801 controls the resistance heating members 61 belonging to the groups A, C, D, and E not to generate heat. Meanwhile, the control unit 801 controls the resistance heating members 61 belonging to the group B to generate heat.

Next, in a case of the label sheet P4, the heating member corresponding to an end portion of the label sheet P4 includes the resistance heating members 61 belonging to the groups A and E. Accordingly, the resistance heating members 61 belonging to the groups A and E are the end portion heating member. The groups A and E are stored in the storage unit 803 in association with the label sheet P4.

When the label sheet P4 is selected by the control panel 600, the control unit 801 obtains the groups A and E. With this process, the control unit 801 designates the heating member corresponding to the end portion of the label sheet P4 as the end portion heating member. Then, the control unit 801 controls the designated end portion heating member not to generate heat. Meanwhile, the control unit 801 controls the resistance heating members 61 belonging to the groups B, C, and D to generate heat.

As illustrated in FIG. 8, the control unit 801 controls the temperature of the resistance heating members 61 corresponding to the end portion of the label sheet to be a temperature lower than that of another resistance heating member 61. With this, as compared to the case where all the resistance heating members 61 generate heat, it is possible to suppress the dirt that is formed due to the adhesive that leaks from the label sheet. Furthermore, as compared to the case where all the resistance heating members 61 generate heat, it is possible to reduce power consumption.

Figure 9:
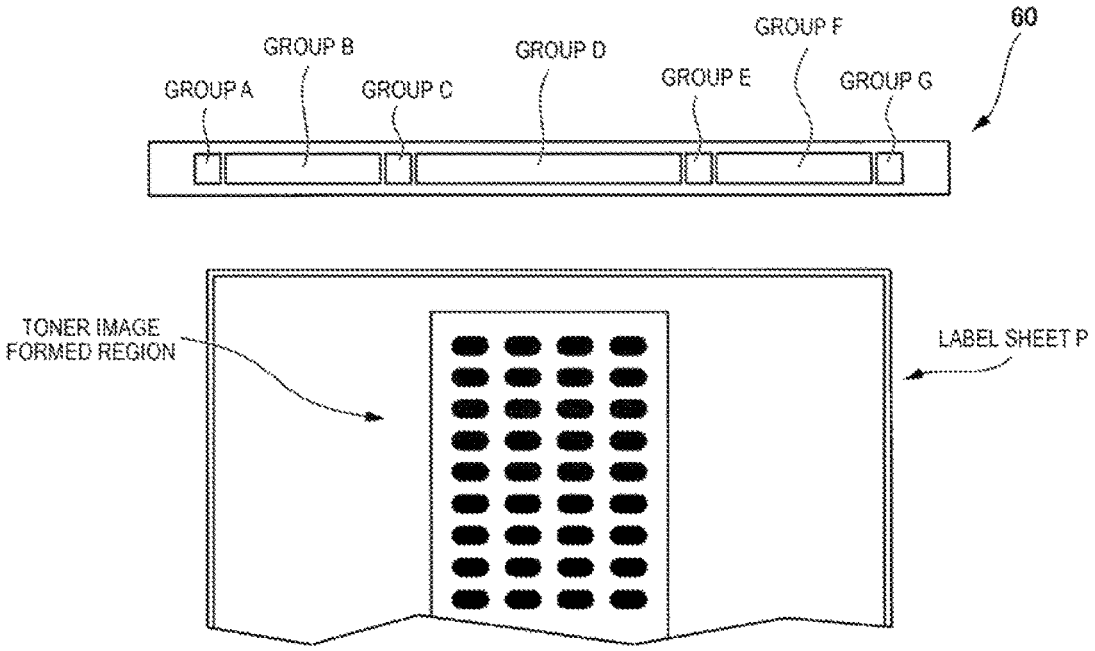
FIG. 9 is a diagram illustrating an example of correspondence between the grouped resistance heating member and a region on which a toner image is not formed.

Next, an example in which the control unit 801 controls the temperature of the resistance heating members 61 corresponding to the region on which a toner image is not formed to be a temperature lower than that of another resistance heating member 61, will be described. FIG. 9 is a diagram illustrating an example correspondence between the grouped resistance heating members 61 and a region on which the toner image is not formed. First, the position on which the toner image is formed can be obtained by the image forming unit P. The control unit 801 can designate the group of the resistance heating members 61 corresponding to the region on which the toner image is not formed, from the position on which the toner image is formed.

In FIG. 9, the resistance heating members 61 included in the resistance heating member 60 are grouped into seven groups A to G. In addition, a toner image region is represented on the label sheet P. The toner image region is in a rectangular region.

In a case of the label sheet P, the heating member corresponding to the end portion of the label sheet P includes the resistance heating members 61 belonging to the groups A and G. Accordingly, the resistance heating members 61 belonging to the groups A and G are the end portion heating member. The groups A and G are stored in the storage unit 803 in association with the label sheet P. Furthermore, the heating members corresponding to the resistance heating members 61 corresponding to the region on which the toner image is not formed include the resistance heating members 61 belonging to the groups B, C, E, and F.

When the label sheet P is selected by the control panel 600, the control unit 801 obtains the groups A and G. With this, the control unit 801 designates the heating member corresponding to the end portion B of the label sheet P as the end portion heating member. Furthermore, the control unit 801 designates the group of the resistance heating members 61 corresponding to the region on which the toner image is not formed. With this process, the control unit 801 controls the resistance heating members 61 belonging to the groups B, C, E, and F not to generate heat, in addition to the resistance heating members 61 belonging to the above-described groups A and G. Meanwhile, the control unit 801 controls the resistance heating members 61 belonging to the group D to be heated as usual. "Heating as usual" means heating to a temperature at which print quality can be ensured.

As described above, the control unit 801 controls the temperature of the resistance heating member 61 corresponding to the end portion of the label sheet to be a temperature lower than that of another resistance heating member 61. Furthermore, the control unit 801 controls the temperature of the resistance heating members 61 corresponding to the region on which the toner image is not formed to be a temperature lower than that of another resistance heating member 61. With this, as compared to the case where all the resistance heating members 61 generate heat, it is possible to suppress the dirt that is formed due to the adhesive that leaks from the label sheet. Furthermore, as compared to the case where all the resistance heating members 61 are heated, it is possible to reduce power consumption.

According to the image forming apparatus 1 of the embodiment described above, it is possible to provide an image forming apparatus which can suppress dirt build-up due to the adhesive that leaks from the label sheet.

As described above, in the fixing device 30, since the label sheet is not only heated, but also clamped, the adhesive tends to leak very easily. Then, as illustrated in this embodiment, by controlling the temperature of the end portion heating member to be a temperature lower than that of another heating member, it is possible to suppress the dirt that is formed due to the adhesive that leaks from the label sheet. Meanwhile, since a position to which the toner image is transferred is heated according to this embodiment, it is possible not only to suppress the dirt build-up due to the adhesive, but also to ensure the print quality and reduce power consumption.

In the above-described embodiment, the end portion heating member is controlled not to generate heat, but may be controlled to generate heat and increase in temperature to a lower point than that of another resistance heating member 61. This control is suitable for the following cases. For example, there are cases where printing is continuously performed on the label sheets of different types and the heating member which has been designated as the end portion heating member is not designated as the end portion heating member in the label sheet to be printed next. In such a case, it is possible to quickly perform next printing as compared to a case where heat is not generated at all.

Figure 10:
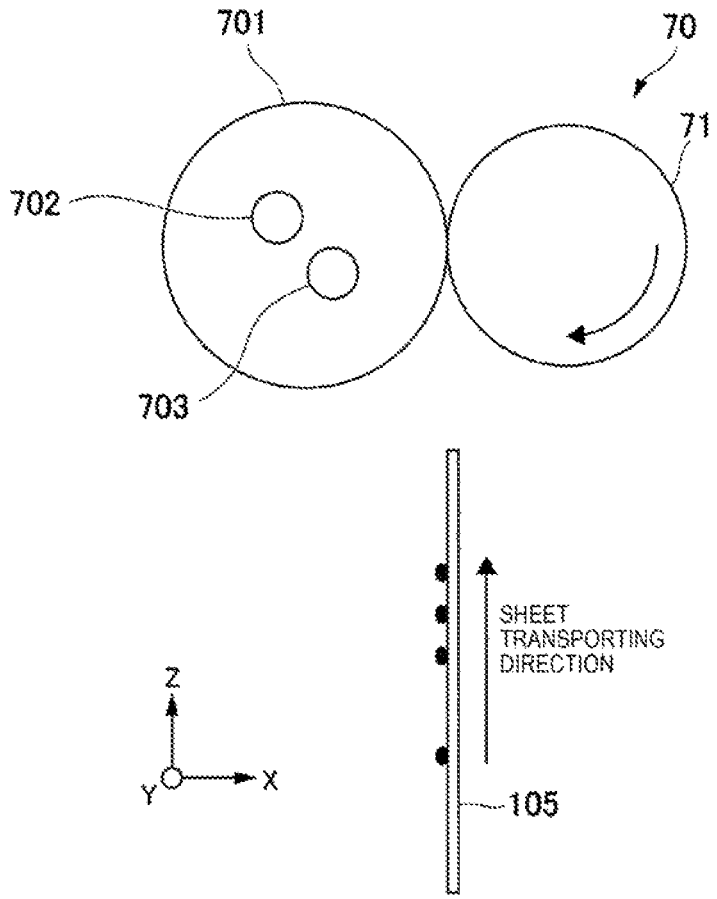
FIG. 10 is a diagram illustrating a configuration example of a fixing device.

In the above-described embodiment, a fixing device 70 illustrated in FIG. 10 may be used instead of the fixing device 30. FIG. 10 is a diagram illustrating an example of the fixing device 70. The fixing device 70 includes a pressure roller 71 and a fixing roller 701. The fixing roller 701 includes an end portion heater 702 and a center heater 703. The fixing device 70 heats the sheet 105 by the pressure roller 71 and the fixing roller 701, or transports the sheet 105 while clamping it.

Figure 11:
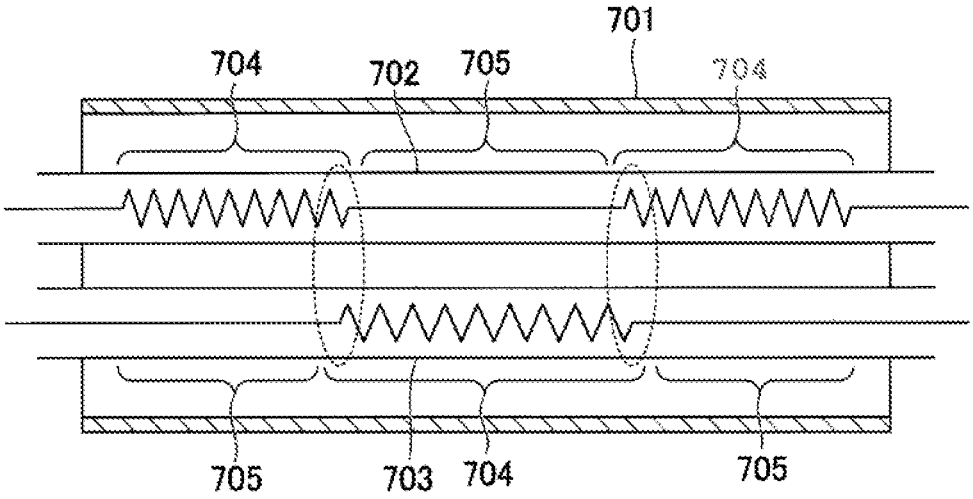
FIG. 11 is a diagram illustrating a configuration example of an end portion heater and a center heater.

FIG. 11 is a diagram illustrating an example of the end portion heater 702 and the center heater 703. The end portion heater 702 heats end portions of the sheet 105. Heating units 704 are provided at end portions of the end portion heater 702 such that the center of end portion heater 702 becomes a non-heated unit 705. The center heater 703 heats the center of the sheet 105 and the heating unit 704 is provided at the center of the center heater 703 such that the end portions become the non-heated units 705.

An application example of such a fixing device 70 to the above embodiment will be described. First, for example, the end portion heater 702 is set as a group X and the center heater 703 is set as a group Y. Then, the groups X and Y generated heat according to the label sheet. For example, in a case where an end portion of a label sheet Z corresponds to a position of the group X, only the group Y generates heat and the group X does not generate heat. By doing so, as compared to a case where the end portion heater 702 and the center heater 703 generate heat, it is possible to suppress the dirt that is formed due to the adhesive that leaks from the label sheet Z. Furthermore, as compared to a case where the end portion heater 702 and the center heater 703 generate heat, it is possible to reduce power consumption.

As described above, the heating member 32, the end portion heater 702, and the center heater 703, in a general image forming apparatus, are controlled to partially generate heat. According to the image forming apparatus which can partially generate heat, the embodiment can be applied similar to a case where it is applied to the fixing device 70.

A function of the image forming apparatus in the above-described embodiment may be implemented in a computer. In this case, a program for implementing this function may be recorded on a computer-readable recording medium, and the program recorded on this recording medium may be read and executed in a computer system. The "computer system" referred thereto includes an OS and hardware such as peripheral devices. In addition, the "computer-readable recording medium" refers to a storage medium such as a portable medium such as a flexible disk, a magneto-optical disk, a ROM and a CD-ROM, or a hard disk built in the computer system. Furthermore, the "computer-readable recording medium" may include a medium that holds program dynamically for a short time, as a communication line for transmitting a program via a network such as the Internet or a communication line such as a telephone line, and may include a device holding a program for a certain period of time such as a volatile memory in a computer system serving as a server or a client in that case. In addition, the program may implement a part of the above-described function, and may be a program in which the above-described function can be implemented by combining with the program already recorded in the computer system.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a sheet transport path;

a toner image transfer section along the sheet transport path at which a toner image is transferred to a sheet conveyed along the sheet transport path;

a heating unit downstream from the toner image transfer section in a sheet transporting direction, the heating unit having a plurality of heating members arranged along a sheet width direction; and a control unit configured to determine locations of end portions of a label on the sheet in the sheet width direction, and during heating of the sheet by the heating unit, control heating members at locations facing the end portions of the label to generate less heat than the one or more of the other heating members.

2. The apparatus according to claim 1, further comprising:

a fixing unit configured to heat the sheet using the heating unit and transport the sheet while clamping the sheet.

3. The apparatus according to claim 1, further comprising:

a control panel through which a sheet type corresponding to the sheet is input, wherein the control unit determines the locations of the end portions of the label on the sheet according to the sheet type.

4. The apparatus according to claim 3, wherein the sheet type includes a first sheet type and a second sheet type, and the heating members that are controlled to generate less heat when the first sheet type is input are different from the heating members that are controlled to generate less heat when the second sheet type is input.

5. The apparatus according to claim 1, wherein the control unit is further configured to determine regions along the sheet width direction where a toner image is not formed along the entire length of the sheet, and the heating members that generate less heat face the regions when the sheet passes through the heating unit.

6. The apparatus according to claim 1, wherein the sheet that passes through the heating unit is centered in the sheet width direction.

7. The apparatus according to claim 1, wherein the sheet that passes through the heating unit is off-center in the sheet width direction.

8. The apparatus according to claim 1, wherein the heating unit comprises a resistance heating unit.

9. An image forming apparatus comprising:

a sheet transport path;

a toner image transfer section along the sheet transport path at which a toner image is transferred to a sheet conveyed along the sheet transport path;

a fixing unit downstream from the toner image transfer section in a sheet transporting direction, the fixing unit including a plurality of heating members arranged along a sheet width direction; and a control unit configured to determine locations of end portions of a label on the sheet in the sheet width direction, and during fixing of the sheet by the fixing unit, control heating members at locations facing the end portions of the label to generate no heat.

10. The apparatus according to claim 9, wherein the heating members each include a plurality of independently controlled resistance heating elements.

11. The apparatus according to claim 9, further comprising:

a control panel through which a sheet type corresponding to the sheet is input, wherein the control unit determines the locations of the end portions of the label on the sheet according to the sheet type.

12. The apparatus according to claim 11, wherein the sheet type includes a first sheet type and a second sheet type, and the heating members that are controlled to generate no heat when the first sheet type is input are different from the heating members that are controlled to generate no heat when the second sheet type is input.

13. The apparatus according to claim 9, wherein the control unit is further configured to determine regions along the sheet width direction where a toner image is not formed along the entire length of the sheet, and the heating members that generate no heat face the regions when the sheet passes through the heating unit.

14. The apparatus according to claim 9, wherein the sheet that passes through the fixing unit is centered in the sheet width direction.

15. The apparatus according to claim 9, wherein the sheet that passes through the fixing unit is off-center in the sheet width direction.

16. A method of forming an image on a label sheet, comprising:

transferring a toner image onto a label formed on the label sheet;

conveying the label sheet having the label with the toner image to a fixing unit;

determining locations of end portions of the label on the label sheet in a sheet width direction; and heating the label sheet with a heater that has heating members that are arranged along the sheet width direction, while clamping the label sheet to fix the toner image onto the label, wherein during the heating, controlling the heating members at locations facing the end portions of the label to generate less heat than the one or more of the other heating members.

17. The method according to claim 16, wherein the locations of the end portions of the label on the label sheet are determined according to a type of label sheet that has been specified through a control panel.

18. The method according to claim 17, wherein the type includes a first label sheet type and a second label sheet type, and the heating members that are controlled to generate less heat when the first label sheet type is input are different from the heating members that are controlled to generate less heat when the second label sheet type is input.

19. The method according to claim 16, further comprising:

determining regions along the sheet width direction where a toner image is not formed along the entire length of the label sheet, wherein the heating members that generate less heat face the regions when the label sheet passes through the heater.

20. The method according to claim 16, wherein the heating members each comprise a plurality of resistance heating elements.

* * * * *